284813 0701 -00 02-26-91 47118

01-25-91 095820 78147.0 04995794 2241

United States Patent [19]

Wycliffe

[11] Patent Number: 4,995,794

[45] Date of Patent: Feb. 26, 1991

[54] VACUUM PUMPS

[75] Inventor: Henryk Wycliffe, Crawley, United Kingdom

[73] Assignee: The BOC Group, plc, Windlesham, England

[21] Appl. No.: 341,528

[22] Filed: Apr. 21, 1989

[30] Foreign Application Priority Data

Apr. 22, 1988 [GB] United Kingdom ..... 8809621

[51] Int. Cl.[5] ..... F04B 25/00; F04B 39/00

[52] U.S. Cl. ..... 417/431; 417/432; 417/423.2; 417/423.9

[58] Field of Search ..... 417/431, 432, 423.2, 417/423.4, 423.9, 250; 415/90

[56] References Cited

U.S. PATENT DOCUMENTS 2,148,671 2/1939 Allen ..... 137/565 X
3,536,418 10/1970 Breaux ..... 417/423.4 X
4,534,699 8/1985 Possell ..... 415/90 X
4,621,985 11/1986 Kobayashi et al. ..... 417/250
4,734,018 3/1988 Taniyama et al. ..... 417/423.4

FOREIGN PATENT DOCUMENTS 2088957 12/1984 United Kingdom .

*Primary Examiner*—Arnold Rosenthal
*Attorney, Agent, or Firm*—Robert I. Pearlman; David M. Rosenblum

[57] ABSTRACT

A vacuum pump comprising a pumping chamber having an inlet and an outlet through which gas from an enclosure connectible to the inlet can be pumped, in which means are provided to allow the selective introduction through the chamber of a flow of recirculating purge gas to effect pumping of the chamber, the means preferably being such that the recirculating purge gas is produced in a gas circuit including the inlet and the outlet and also including a filter.

7 Claims, 1 Drawing Sheet

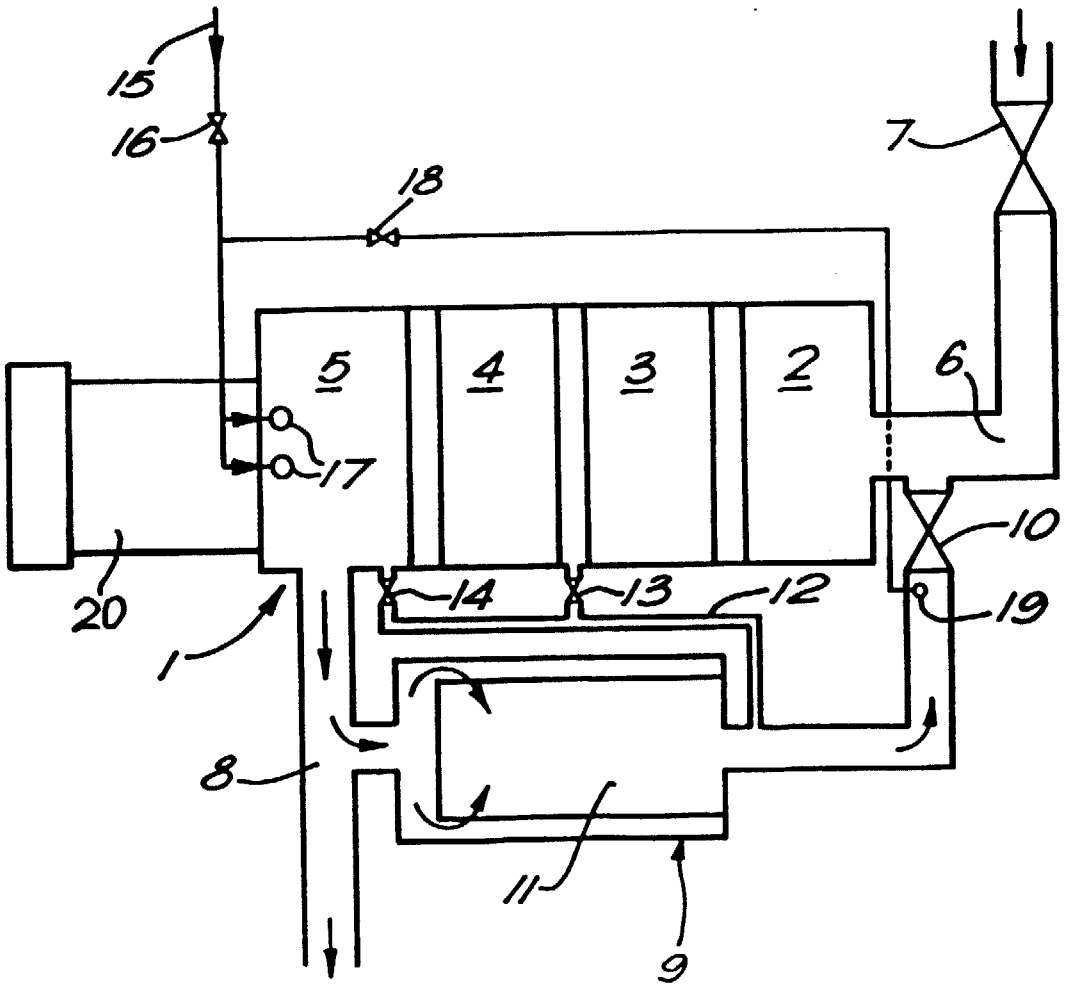
7
6
10
19
2
12
3
13
4
14
5
17
18
15
16
20
1
8
9
11

VACUUM PUMPS

BACKGROUND OF THE INVENTION

This invention relates to vacuum pumps and in particular to oil free or dry mechanical vacuum pumps.

A typical oil free or dry pump, i.e. one having an oil free swept volume, is disclosed and described in our UK Patent Specification Ser. No. 2,088,957. The particular pump described therein can comprise a plurality, for example four pumping chambers, each containing intermeshing pairs of rotors to effect pumping action. Some of the chambers particularly the one at the pump inlet, can have rotors of the 'Roots' type whereas other can have rotors of the 'Claw' type. Shafts for driving the rotor pairs are interconnected by meshing gears enclosed in a housing at one end of the pump casing, one of the shafts extending beyond the housing for connection to a prime mover such as an electric motor. The housing, and the seals relating thereto, are such that oils or lubricants associated with the gears, etc. are prevented from leaking into the pumping chambers.

Oil free mechanical pumps of this type can generally provide a high volumetric pumping efficiency and are normally capable of evacuating an enclosure to a pressure of the order of $10^{-2}$ torr.

The absence of lubricant within the pumping chambers of such pumps makes them more suitable for applications where a dust or detritus laden gas has to be pumped from an enclosure. Any such lubricants present in the pumping chamber would act as a "scrubber" for such contaminants and can produce an abrasive slurry effective to induce rapid and excessive wear on the pump internal surfaces.

However, it has been found that in oil free mechanical vacuum pumps, particularly dry pumps such as are disclosed and claimed in the above UK patent, there can nonetheless be a progressive build up of contaminants such as dust and like detritus which arises mainly from the gas being evacuated or pumped from the enclosure. The processing of semi-conductor materials in the enclosure in particular, such as the coating of wafers of semi-conductor material, is known to produce significant quantities of such contaminants in the form of dust, detritus and the like.

It has also been found that over an extended period of pump operation, such contaminants can build up in a dry pump of the type with which this invention is concerned. It is thought that such build up can cause the pumps mechanically to seize for want of adequate clearance between relatively moving parts. Alternatively, particles of accumulated dust which have formed on the surfaces of the pump may break off in relatively large pieces and lock or trap the pump mechanism.

It has previously been proposed to overcome the problem of build up of contaminants by continuously introducing a dry, inert purge gas into a stage of the pump downstream of the inlet stage during the period of actual operation, i.e. with the pump evacuating an enclosure. This approach however suffers from the disadvantage that injection of such a purge gas adversely affects the volumetric pumping efficiency of the pump unless the purge gas injection rate is minimal; in such cases, however, the purging effect of the gas is substantially reduced and a little gain in purging is achieved at the cost of a loss of volumetric pumping efficiency.

The present invention is concerned with the provision of an oil free mechanical vacuum pump in which the build up of contaminants can be minimised.

SUMMARY OF THE INVENTION

In accordance with the invention, there is provided a vacuum pump comprising a pumping chamber having an inlet and an outlet and through which gas from an enclosure connectable to the inlet can be pumped, wherein means are provided to allow the selective introduction through the chamber of a flow of recirculating purge gas to effect purging of the chamber.

To effect a recirculating flow of purge gas through the chamber, it will commonly be necessary, but not essential, selectively to isolate the chamber inlet from the enclosure and preferably valve means are provided for this purpose.

The purge gas is preferably dry and inert so that it does not detrimentally affect the pump itself or introduce contaminants or moisture into the pumping chamber or other parts of the pump. Nitrogen is a useful purge gas and is preferred. Means for introducing the purge gas into the pump may be placed at any suitable position in the pump. Once introduced, recirculation of the purge gas through the chamber is preferably effected by operation of the pump itself.

Ideally, the flow of purge gas is produced in a gas circuit, which preferably should effectively be a closed circuit, including the inlet and the outlet of the pumping chamber and the chamber itself.

Such a gas circuit advantageously includes a filter effective to trap and retain contaminants and other detritus which are displaced from the pump components by the purge gas flow.

The filter can usefully be contained in a conduit arranged in parallel with the pumping chamber and linking the chamber inlet and the chamber outlet, whereby the gas circuit for recirculating purge gas includes the chamber and the filter-containing conduit.

In such cases, valve means are preferably provided in the conduit for selectively closing the conduit, and hence isolating the gas circuit, when the valve means are closed.

The pumping chamber may comprise a first chamber and at least one further chamber. Pumps of this type will usually have two or three further pumping chambers with each individual chamber containing its own pumping elements such as the intermeshing rotors described in the introduction above.

In certain circumstances, it may be expedient for means to be provided to allow the flow of purge gas to be effected selectively through the further chambers. In particular, supplementary conduits can be provided to cause the flow of purge gas to include not the first pumping chamber but only one or more of the further pumping chambers. Such supplementary conduit preferably possess valve means for selectively bringing them into use.

In certain embodiments of the invention, it may be useful to provide supplementary means for the introduction of purge gas into the pump. In particular, an ability to introduce purge gas into the filter conduit, even when no purge gas was being circulated through the pumping chamber, would be useful in the case when dangerous, for example pyrophoric, gas was being pumped from an enclosure to prevent accumulation of such dangerous gas in the conduit.

The pump of the invention allows the level of contaminant build up to be minimised. In particular, the velocity and throughput of purge gas through the pumping chamber can be varied and increased to optimise contaminant removal. It is thought that effective contaminant removal may be achieved in many cases only if the velocity and throughput of purge gas is much greater than the gas velocity/throughput during normal pumping from an enclosure to be evacuated.

The pump of the invention allows this to happen:

firstly, in certain embodiments, by providing means for isolating, in use, the pumping chamber inlet from the enclosure to be evacuated and thereafter pumping purge gas through a gas circuit at a velocity and throughput necessary to remove the contaminants, and secondly, in certain other embodiments, by allowing the purge gas to flow only through further pumping chambers so that continued normal use of the first pumping chamber in communication with an enclosure maintains usual evacuation/pumping of that enclosure whilst allowing the removal of contaminants from the further chambers.

BRIEF DESCRIPTION OF THE DRAWINGS

To illustrate the invention, reference will now be made, by way of exemplification only, to the accompanying drawing which is a schematic view of a vacuum pump of the invention.

DETAILED DESCRIPTION

Referring to the drawing, the pump shown therein is an oil/lubricant free mechanical pump generally indicated at 1 of the type disclosed in our UK Patent Specification Ser. No. 2,088,957. The pump 1 has a pumping chamber comprising a first chamber 2 and three further chambers 3, 4 and 5 all of which contain intermeshing pairs of rotors (not shown). The first chamber 2 in particular commonly has rotors of the 'Roots' type.

The pumping chamber has an inlet 6 which is connectible via valve means 7 to an enclosure (not shown) to be evacuated and an outlet 8 via which exhaust gases from the pumping chamber are expelled. Gears and a motor for driving and controlling the intermeshing pairs of rotors are contained in a housing 20.

Linking the inlet 6 and the outlet 8 is a conduit 9 arranged in parallel with the pumping chamber. The conduit has valve means 10 which, when open, allows the formation of a gas circuit including the inlet 6, the pumping chamber 2, 3, 4, 5, the outlet 8 and the conduit 9.

Included in the circuit is a cylindrical filter element 11 which is mounted in the conduit 9 in a manner such that gas flowing from the outlet 8 to the inlet 6 must flow through the filter element 11 in the direction shown by the arrows. The filter element itself may be made of any suitable material for entrapment of contaminants in the gas flowing therethrough.

Supplementary conduit means 12 are also provided selectively to link the main conduit 9 with the further pumping chambers 4 and 5 via valve means 13 and 14 respectively; the link with chamber 4 is into a partition wall between pumping chambers 3 and 4 whilst the link with chamber 5 is direct into the chamber.

A source of purge gas is supplied via gas line 15 and valve means 16 to dual ports 17 in pumping chamber 5 and, separately, via valve means 18 to a port 19 in the conduit 9.

In normal operation of the pump 1 when evacuating an enclosure, especially one in which a dust-laden gas evolved in a process being conducted in the enclosure, valve 7 will be open with valve 10 being closed. During such normal operation, valve 16 may also be open in certain circumstances to admit purge gas, for example dry nitrogen, into the system to prevent, for example, pyrophoric action. In this mode, the enclosure will be evacuated by the pump 1 which will in time ingest and progressively trap a quantity of contaminants and detritus drawn from the enclosure.

After suitable time, for example after completion of a process cycle in the enclosure, the valve 7 is closed and the pump 1 is operated with valve 10 open. Valve 16 also remains open to admit purge gas into the pump.

In this operational mode, the filter element 11 will be included in a substantially closed circuit with all the pumping chambers 2, 3, 4 and 5 of the pump 1 and, with pump 1 driven, the increased gas velocity and throughput, which may be enhanced by the injection of additional amounts of purge gas, will be effective to dislodge contaminants and other detritus trapped within the pump 1 and to drive such contaminants into the filter unit for retention therein and subsequent removal, preferably by means of a disposable filter element.

In an alternative mode of operation, some purging of the pump 1 may be achieved during normal operation with the valve 7 open and the pump being effective to evacuate the enclosure. In this mode, the valve 10 remains closed, with the valves 13 and/or 14 being open to enable the pump 1 to form a closed circuit or circuits with the filter 11 and chambers 4 and 5 respectively of the pump. In this way, some degree of continuous purging is achieved because purge gas enters pumping chambers 4 and 5 rather than the pumping chambers 2 and 3 and the purging effect is therefore achieved without excessive loss of volumetric pumping efficiency.

It will be appreciated that the purging operation at the completion of each process cycle as described above can be undertaken irrespective of whether purging during normal pumping, i.e. with valves 13 and 14 open is performed.

It will equally be appreciated that the purging operation of the pump can, if desired, be undertaken merely at regular intervals between a number of process operations within the evacuated enclosure, particularly if the level of contamination generated by the process operation is relatively low. However, whatever method of purging provided by the present invention is utilised, a build up of contaminants within the pump 1 will be considerably reduced.

Depending on the type of gas being evacuated from the enclosure, especially in the case of explosive or pyrophoric gases, it may be advantageous to introduce purge gas continuously from the gas line 15 to the port 19, particularly when the valve means 10 is closed, to prevent the possibility of any build up of evacuated gas in the conduit 9, including the filter element 11, or the supplementary conduit. Any evacuated gas will be driven from the conduits into the outlet 8 by the purge gas introduced into the port 19.

It will be appreciated that a substantive advantage of the recirculation system of the present invention is that it can utilise purge gas already present in the pump 1 and in the pumping system, to effect the purging of entrapped contaminants and other detritus. The recirculation system using dry purge gas merely to increase the volume of gas in the pump and the pumping system to produce the necessary gas flow and throughput is thus more economical than continuously feeding dry dilution gas into the pump inlet to effect purging.

What is claimed is:

1. A vacuum pump comprising a pumping chamber having an inlet and an outlet and through which gas from an enclosure connectible to the inlet can be pumped, a conduit, arranged in parallel with the pumping chamber, linking the inlet and the outlet of the pumping chamber, and having a filter, and means for allowing the selective introduction of a flow of recirculating purge gas to a gas circuit including the inlet and the outlet of the pumping chamber, the conduit, the filter and the pumping chamber to effect purging of the pumping chamber.

2. The vacuum pump of claim 1 in which valve means are provided selectively to isolate the inlet from the enclosure.

3. The vacuum pump of claim 1 in which the flow of purge gas through the chamber is effected by operation of the pump.

4. The vacuum pump of claim 1 in which valve means are provided in the conduit for selectively closing the conduit.

5. The vacuum pump of claim 1 in which the pumping chamber comprises a first chamber and at least one further chamber.

6. The vacuum pump of claim 5 in which supplementary conduit means are provided to allow the flow of purge gas to be effected selectively through the further chamber(s).

7. The vacuum pump of claim 6 in which supplementary conduits are provided to cause the flow of purge gas to include not the first pumping chamber but only one or more of the further pumping chambers.

* * * * *